United States Patent [19]

Welch

[11] Patent Number: 4,483,689

[45] Date of Patent: Nov. 20, 1984

[54] ABRASION-RESISTANT DURABLE-PRESS ACRYLIC FINISHES FOR COTTON TEXTILES BY USE OF NONOXIDATIVE POLYMERIZATION INITIATORS AND ACCELERATORS IN TWO-STAGE HEAT CURING

[75] Inventor: Clark M. Welch, New Orleans, La.

[73] Assignee: The United States of America as represented by the Secretary of Agriculture, Washington, D.C.

[21] Appl. No.: 518,779

[22] Filed: Jul. 29, 1983

[51] Int. Cl.[3] ..... D06M 15/54; D06M 15/64; D06M 15/60

[52] U.S. Cl. ..... 8/184; 8/194; 8/116 P

[58] Field of Search ..... 8/184, 116 P, 194

[56] References Cited

U.S. PATENT DOCUMENTS

| | | | |
|---|---|---|---|
| 3,125,405 | 3/1964 | Gardon | 8/184 |
| 3,125,406 | 3/1964 | Herman | 8/184 |
| 3,561,916 | 2/1971 | Baitinger | 8/184 |
| 3,958,932 | 5/1976 | Rowland et al. | 8/184 |
| 4,052,158 | 10/1977 | Weil | 8/184 |
| 4,255,149 | 3/1981 | Rowland et al. | 8/184 |

OTHER PUBLICATIONS

Kamogawa et al., Textile Research Jour.–Oct. 1960, pp. 774–781.

Stanley P. Rowland et al., "Polymerization–Crosslinking of N-Methylolacrylamide in Cotton Fabric"; Textile Research Journal vol. 48, No. 2, 73–80 (1978).

J. G. Frick, Jr., and Gloria Gautreaux; "Polymerization of Acrylic Compounds on Cotton Fabrics" American Dyestuff Reporter 59 [12] 40–42, 44,50 (1970).

Wolfram et al., "Wool Containing Vinyl Polymers: Production and Some Properties"; American Dyestuff Reporter 56 [4] 110–116 (1967).

*Primary Examiner*—Maria Parrish Tungol

*Attorney, Agent, or Firm*—M. Howard Silverstein; David G. McConnell; Raymond C. Von Bodungen

[57] ABSTRACT

The use of 4,4'-azobis(4-cyanovaleric acid) and its salts as water-soluble free radical initiators, and simultaneously or alternatively the addition of catalytic amounts of tetrakis(hydroxymethyl)phosphonium sulfate as a polymerization accelerator, in the sequential polymerization and acid-catalyzed grafting of N-methylolacrylamide on cotton textiles from a single treating bath in a padding and two-stage heat curing operation, is disclosed. The cotton textiles as treated are free from discoloration and excessive tendering produced by peroxide-type initiators, and these textiles exhibit increased smooth drying performance, abrasion resistance and strength relative to textiles treated conventionally with dimethyloldihydroxyethyleneurea to comparable wrinkle recovery angles.

11 Claims, No Drawings

ABRASION-RESISTANT DURABLE-PRESS ACRYLIC FINISHES FOR COTTON TEXTILES BY USE OF NONOXIDATIVE POLYMERIZATION INITIATORS AND ACCELERATORS IN TWO-STAGE HEAT CURING

BACKGROUND OF THE INVENTION (1) Field of the Invention

This invention relates to a new method of imparting wrinkle resistance, smooth drying properties and abrasion resistance to textiles made of cotton fibers or blends of cotton with polyester.

(2) Description of the Prior Art

Although many types of chemical treatment have previously been recommended to render cotton textiles wrinkle resistant in the dry state at ordinary humidity, and to make cotton textiles smooth drying when laundered in the wet state and then dried, without exception these treatments have greatly lowered the strength, abrasion resistance, and laundering life of the cotton. As a consequence, textile mills have found it necessary to introduce chemically inert synthetic fibers as blends with cotton in the manufacture of wearing apparel and bedsheets in which smoothness and wrinkle-free appearance are important. In textiles where the superior comfort and moisture absorption of cotton make its use necessary at levels as high as 60%–100% in the fabric, the conventional durable press treatments with dimethyloldihydroxyethyleneurea cause the cotton cellulosic fibers to become weakened and embrittled so that a few machine launderings produce ragged and frayed edges in garment cuffs and collars, worn or frosted lines and holes in creases, and thin areas in sheets.

Recently an important advance in overcoming this loss of abrasion resistance and strength during durable press finishing of cotton has been reported by Rowland et al, Textile Research Journal 48, 73–80 (1978) and U.S. Pat. No. 4,255,149 Mar. 10, 1981). Using ammonium persulfate as the free radical initiator in the presence of an alkali metal phosphate, they were able to graft polymerize N-methylolacrylamide on cotton fabric to impart high levels of wrinkle resistance and durable press performance with retention of high flex abrasion resistance and high resistance to weight loss during Accelerator abrasion. Breaking and tearing strength losses were also reduced somewhat.

A major difficulty in any attempt at commercial scale use of their process is that the heat curing step "caused pronounced discoloration of fabric" if carried out in air. To prevent this they found it necessary to heat cure the fabrics wrapped in a plastic bag filled with nitrogen. Moreover, on a lightweight fabric such as 3.2 oz/yd$^2$ printcloth, heat curing in air noticeably reduced the strength. With most existing mill equipment, heat curing of fabric under a nitrogen atmosphere would be impracticable on a commercial scale. Atmospheric oxygen was suggested as being disadvantageous during heat curing.

However, earlier studies by Frick et al (American Dyestuff Reporter 59 [12] 40–42, 44, 50 (1970)) showed that ammonium persulfate itself produced degradation of cotton cellulose and large fabric strength loss when used as the initiator in the free radical polymerization of acrylamide on cotton fabric by heat curing in air. Heat curing the fabric in a nitrogen-filled bag increased the polymer yield and process reproducibility, but did not decrease fabric degradation. The degradation was caused by reaction of the ammonium persulfate initiator as an oxidizing agent to form "active" or free radical sites directly on cellulose.

Also related to the present invention is the discovery of Wolfram et al (American Dyestuff Reporter 56 [4] 110–116 (1967)) that tetrakis(hydroxymethyl)phosphonium chloride (THPC) acts as an oxygen scavenger in aqueous solution, and when present in catalytic amounts together with a persulfate salt which serves as the polymerization initiator, THPC permits vinyl and acrylic monomers to be polymerized in situ in the fibers of wool textiles even in an oxygen-containing atmosphere which normally would inhibit or retard the polymerization. Wolfram et al observed, however, that in the absence of persulfate initiator, no polymerization occurred even with THPC present. Thus, the phosphonium salt, THPC, is not an initiator of free radical polymerization of vinyl or acrylic monomers, but does act as an accelerator by removing atmospheric oxygen which acts as an inhibitor of the polymerization.

SUMMARY OF THE INVENTION

This invention provides processes for imparting to cotton and other cellulosic textiles a high level of wrinkle resistance and smooth drying properties, together with a high level of abrasion resistance, while retaining high tearing and breaking strength in the textile, as well as freedom from discoloration.

In these processes N-methylolacrylamide is polymerized on the cellulosic textile at moderately elevated temperatures in the presence of a water-soluble agent which, without being an oxidizing agent toward cellulose, serves as a generator of free radicals that initiate vinyl polymerization or the agent serves as an accelerator of vinyl polymerization initiated by heat alone, there also being present an acid catalyst inactive toward the N-methylolacrylamide at this temperature, and the polymerization step is followed by a second stage of heating at a still higher temperature at which the acid catalyst becomes active and causes multiple grafting of the poly(N-methylolacrylamide) to the cellulose of the textile via acid-catalyzed etherification of cellulose hydroxyl groups by N-methylol groups of the polymer, thereby crosslinking the cellulose.

As nonoxidizing, water-soluble free radical generators the processes of this invention utilize 4,4'-azobis(4-cyanovaleric)acid and its water-soluble ammonium, amine and alkali metal salts. Accelerators suitable for speeding the vinyl polymerizations of the present invention include tetrakis(hydroxymethyl)phosphonium sulfate, chloride and phosphate salts, and those may be used as an alternative to the azo free radical generator or in conjunction with the latter.

Suitable as acid catalysts for the grafting of poly(N-methylolacrylamide) to cellulose are zinc sulfate-phosphoric acid combination catalysts buffered by monosodium phosphate, or alternatively, zinc nitrate with or without buffers.

The main object of the present invention is to provide a process for improving the wrinkle resistance and smooth drying characteristics of cotton-containing textiles while preventing or decreasing the loss of abrasion resistance encountered in prior art processes, and reducing the strength losses also previously encountered.

A second object of the present invention is to provide a rapid process for polymerization and grafting of acrylic monomers on cotton in a normal air atmosphere while avoiding the discoloration, cellulose degradation, and excessive tendering produced in cotton by peroxide-type free radical polymerization initiators.

A third object of the present invention is to carry out the N-methylolacrylamide polymerization on cotton at temperatures too low for the free radical initiator to cause undesired chain reactions in the cellulose, and by using the initiator in this step, to avoid free radical degradation of cellulose during subsequent high temperature grafting of poly(N-methylolacrylamide) to the cellulose.

A fourth object of the present invention is to permit separate control of the N-methylolacrylamide polymerization and cellulose grafting steps while using but one treating bath and a single pad-dry-cure cycle.

DESCRIPTION OF THE PREFERRED EMBODIMENTS

The present invention is applicable to textiles containing not less than 30% by weight of cellulosic fibers including cotton, flax, jute, hemp, ramie and regenerated unsubstituted wood cellulose such as rayon. The processes disclosed are most advantageous with textiles containing 50%–100% cotton and may be applied to fibers or linters, roving sliver, yarns, woven or knit fabrics, as well as nonwoven textiles and paper.

The present invention is based on the discovery that free radical polymerization initiators or accelerators exist, which at moderately elevated temperatures, in the range of 95°–130° C., induce rapid polymerization of vinyl groups in vinyl and acrylic monomers, and particularly vinyl groups in N-methylolacrylamide, within the fibers of cellulosic textiles and without the oxidative degradation or discoloration of the cellulose that occur if peroxide-type initiators such as persulfate salts are used as the initiators at these temperatures. The polymerization takes place within 0.5 minutes to 10.0 minutes. Further, the present invention makes use of the fact that if Bronsted-Lowry or Lewis acid catalysts are present, the N-methylol groups of the polymerized N-methylolacrylamide can be made to react with hydroxyl groups of the cellulosic fibers of the textile being treated, but this reaction takes place only at relatively high temperatures in the range of 145°–180° C., over periods of 0.5 minutes to 6.0 minutes.

Thus, by carrying out polymerization of the vinyl groups of N-methylolacrylamide at 95°–130° C. in the presence of the properly chosen initiators or accelerators, this step can be conducted prior to grafting of the poly(N-methylolacrylamide) to cellulose via acid-catalyzed reaction of N-methylol groups of the polymer with cellulose hydroxyl groups at 145°–180° C. In so doing the free radical initiator is used up in the vinyl polymerization step and is no longer present to cause undesired free radical chain reactions, degradation and discoloration in the cellulose after the temperature is raised to 145°–180° as needed for grafting the acrylic polymer to cellulose. Moreover, the degree of crosslinking that occurs in the homopolymerization of N-methylolacrylamide can readily be controlled at the lower temperature range (95°–130° C.) particularly by adding the proper concentrations of initiator and of an unsaturated crosslinking agent such as N,N'-methylenebis(acrylamide) which does not react with the cellulose but does enter into the free radical vinyl copolymerization with N-methylolacrylamide. Concentrations of 0.5%–1.5% of N,N'-methylenebis(acrylamide) are preferred.

Additionally, the oven drying step, which removes water from the fabric after the fabric has been immersed in the aqueous treating bath, can be carried out simultaneously with the monomer polymerization step, thus making for increased simplicity and speed of processing.

Vinyl monomers suitable for the process of this invention are N-methylolacrylamide and its homologs such as N-methylolmethacrylamide. The chosen monomer may be used at concentrations of 5%–20% in these processes, still higher concentrations leading to stiffness in the tested textiles, and lower concentrations being ineffective as durable press treatments.

The free radical polymerization initiators suitable for the vinyl polymerization step in the first heating stage of processes of this invention are 4,4'azobis(4-cyanovaleric acid) a known compound and its' water-soluble ammonium, amine and alkali metal salts. These agents act by generation of free radicals which initiate polymerization of vinyl groups. The free acid is soluble in water only to the extent of 0.2% at room temperature, but is easily solubilized by adding to the aqueous suspension of the free acid an equimolar quantity of a base such as ammonia, an amine such as triethylamine or pyridine, or an alkali metal hydroxide or bicarbonate. Even monosodium phosphate in sufficient amount appreciably increases the solubility of the azo initiator. Initiator concentrations of 0.10%–1.0 are effective in inducing the polymerization of the present process.

Unexpectedly it has been found that the vinyl polymerization step can be carried out in the absence of added free radical generators such as these azo compounds, provided certain phosphonium salts are present as oxygen scavengers and polymerization accelerators, and this is the most highly preferred method of the present invention, inasmuch as the textiles so treated have even higher abrasion resistance by the Accelerator weight loss test than is the case when azo free radical initiators are added.

The phosphonium salt most suitable as an accelerator of vinyl polymerization in the present processes is tetrakis (hydroxymethyl)phosphonium sulfate, hereafter referred to as THPS, and it can be used either by itself or with the above free radical initiators in speeding up the polymerization step or increasing the degree of polymerization reached. The molecular structure of THPS is commonly written as $[(HOCH_2)_4P]_2SO_4$, and this agent is a commercially available and widely known flame retardant. The corresponding halide, THPC, has the structure $[(HOCH_2)_4P]Cl$, and is likewise operative in the present process but is less preferable because under certain very limited experimental conditions it may possibly generate bis(chloromethyl)ether, which is known to produce cancer in test animals. Tetrakis (hydroxymethyl)phosphonium dihydrogen phosphate, $[(HOCH_2)_4P]H_2PO_4$, or THPP, has proven to be a very active initiator and accelerator in the vinyl polymerization step, but its use has led to less satisfactory flex abrasion resistance in treated fabric than was observed with THPS, and therefore, the phosphate salt is less preferred as an accelerator than the sulfate. The concentrations of THPS, THPC or THPP effective as accelerators of the polymerization in the present processes are in the range of 0.3%–1.5% by weight.

As acid catalysts for the second-stage high-temperature curing step of the present processes in which the poly(N-methylolacrylamide) is grafted to the cellulose to produce crosslinking in the cellulose, a zinc salt of a strong mineral acid is required when 4,4'-azobis(4-cyanovaleric acid) or its salts are used in the first stage polymerization step. Zinc sulfate, zinc nitrate and zinc chloride are preferred Lewis acid catalysts. With 0.10%–1.0% by weight of zinc sulfate as catalyst, 0.25%–1.5% phosphoric acid is needed as a catalyst activator, and 0.15%–2.0% monosodium phosphate is needed as a buffer to improve the strength and abrasion resistance retained in treated fabric, the phosphoric acid and monosodium phosphate being present in a weight ratio ranging from 0.25:1 to 1.5:1, the lower ratios being preferred at the higher phosphoric acid concentrations. If the zinc sulfate and monosodium phosphate used are in hydrated form, the weight of each needed will be proportionately larger. With 0.1%–1.0% zinc nitrate as Lewis acid catalyst, the use of phosphoric acid and monosodium phosphate are not required if the 4,4'-azobis(4-cyanovaleric acid) is present in the form of water soluble ammonia, amine or alkali metal salts at a concentration equivalent to 0.3%–1.0% by weight of 4,4'-azobis(4-cyanovaleric acid).

When THPS or the corresponding phosphonium chloride or phosphate is used as the polymerization accelerator in the first stage heat cure, in absence of azo free radical initiators, the preferred acid catalyst operative in the second stage cure is phosphoric acid at a concentration of 0.25%–1.5% by weight, with monosodium phosphate present as a buffer to the extent of 0.15%–2.0% by weight, the phosphoric acid and monosodium phosphate being present in a weight ratio ranging from 0.25:1 to 1.5:1, the lower ratios being preferred at the higher phosphoric acid concentrations. Optionally, to this combination may be added 0.1%–1.0% by weight of zinc sulfate as a Lewis acid catalyst where extremely high levels of wrinkle resistance are desired.

Optional in the present processes are the use of textile wetting agents, as well as emulsified polyethylenes useful as textile softeners, and other auxiliary agents. The preferred wetting agents are nonionic, since these are compatible with the dissolved zinc salts used in certain of the above processing steps.

The above findings have been used to develop processes for the durable press finishing of cellulosic textiles. One such process which utilizes a free radical initiator comprises the following steps:

(a) immersion of the cellulosic textile in an aqueous treating solution containing from 5% to 20% by weight of N-methylolacrylamide, from 0.10% to 1.0% 4,4'-azobis(4-cyanovaleric acid) solubilized at concentrations exceeding 0.20% by addition of a base selected from the class consisting of ammonia, triethylamine, pyridine, sodium hydroxide and sodium bicarbonate, the amount of said base being one mole per mole of 4,4'-azobis(4-cyanovaleric acid); from 0.15% to 2.0% monosodium phosphate, from 0.25% to 1.5% phosphoric acid, the ratio by weight of phosphoric acid to monosodium phosphate being in the range from 0.25:1 to 1.5:1; from 0.10% to 1.0% of a Lewis acid catalyst selected from the class consisting of zinc sulfate and zinc nitrate, and from 0.50% to 1.5% of N,N'-methylenebis(acrylamide) in water, (b) removal of excess treating solution from the textile, (c) heating the textile at a temperature of from 95° C. to 130° C. for from 0.5 minutes to 10 minutes to dry the textiles and polymerize the N-methylolacrylamide in the fibers of the textile, (d) heating the textile at a temperature of from 145° C. to 180° C. for from 0.5 minutes to 6 minutes to graft the polymerized N-methylolacrylamide to the cellulose of the textile, (e) washing the textile with water to remove excess reagents, and (f) drying the textile.

As an alternative, a process has been developed in which no phosphate buffer is used, which process comprises:

(a) immersion of the cellulosic textile in an aqueous treating solution containing from 5% to 20% by weight of N-methylolacrylamide, from 0.30% to 1.0% of 4,4'-azobis(4-cyanovaleric acid) solubilized by addition of a base selected from the class consisting of ammonia, triethylamine pridine, sodium hydroxide and sodium bicarbonate, the amount of said base being one mole per mole of 4,4'-azobis(4-cyanovaleric acid); from 0.10% to 1.0% of zinc nitrate, and from 0.50% to 1.5% of N,N'-methylenebis(acrylamide) in water, (b) removal of excess treating solution from the textile, (c) heating the textile at a temperature of from 95° C. to 130° C. for from 0.5 minutes to 10 minutes to dry the textile and polymerize the N-methylolacrylamide in the fibers of the textile, (d) heating the textile at a temperature of from 145° C. to 180° C. for from 0.5 minutes to 6 minutes to graft the polymerized N-methylolacrylamide to the cellulose of the textile, (e) washing the textile with water to remove excess reagents, and (f) drying the textile.

A process has been developed in which a chemical accelerator is used to speed N-methylolacrylamide polymerization initiated by heat only, which process comprises:

(a) immersion of the cellulosic textile in an aqueous treating solution containing from 5% to 20% by weight of N-methylolacrylamide, from 0.15% to 2.0% of monosodium phosphate, from 0.25% to 1.5% phosphoric acid, the ratio by weight of phosphoric acid to monosodium phosphate being in the range of 0.25:1 to 1.5:1; from 0.50% to 1.5% of N,N'-methylenebis(acrylamide) in water, and from 0.30% to 1.5% of tetrakis(hydroxymethyl)phosphonium sulfate in water, (b) removal of excess treating solution from the textile, (c) heating the textile at a temperature of from 95° C. to 130° C. for from 0.5 minutes to 10 minutes to dry the textile and polymerize the N-methylolacrylamide in the fibers of the textile, (d) heating the textile at a temperature of from 145° C. to 180° C. for from 0.5 minutes to 6 minutes to graft the polymerized N-methylolacrylamide to the cellulose of the textile, (e) washing the textile with water to remove excess reagents, and (f) drying the textile.

Optionally to the textile treating bath of step (a) of the above process may also be added 0.10% to 1.0% by weight of zinc sulfate where extremely high levels of wrinkle resistance are desired.

Standard test methods which were used to measure properties of the treated fabrics were: conditioned wrinkle recovery angles-ASTM Method D-1295-67, Elmendorf tearing strength-ASTM Method D-1424-63, strip breaking strength-ASTM Method D-1682-64, stiffness by Tinius Olsen Method (Federal Test 191, Method 5202), Stoll flex abrasion resistance-ASTM Method D-1175-55Tb, Accelerator abrasion resistance (weight loss)-AATCC Method 93-1978, run at 3000 r.p.m. for 3 min., durable press appearance ratings with plastic replicas after one laundering and tumble drying cycle-AATCC Method 124-1967.

The following examples are illustrative of processes of the present invention and are not intended to limit the scope of the invention. All parts and percentages are by weight.

Table I. The aqueous treating mixture for DMDHEU treatment contained 5% by weight DMDHEU, 4.0% magnesium chloride hexahydrate, 0.07% nonionic wetting agent, and 2.0% cationic polyethylene softener and was applied to a 110% wet pickup to the printcloth which was oven-dried at 80° C. for 5 minutes and oven-cured at 160° C. for 90 seconds, afterwashed in hot water for 15 minutes and afterdried at 80° C. for 5 minutes. Also appearing in Table I are runs made without the water-soluble azo initiator, or with the first stage cure at 110° C. replaced by a simple predrying at 80° C.

TABLE I

| Lewis Acid | 2nd Stage Cure Time (Seconds) | Fabric Weight Gain | Conditioned Wrinkle Recovery Angle (Warp & Fill) | Durable Press Rating | Retention of Stoll Flex Abrasion Resistance | Warp Tear Strength Retained | Warp Break Strength Retained |
|---|---|---|---|---|---|---|---|
| None | 90 | 10.8% | 290° | 3.6 | 214% | 83% | 66% |
| 0.5% $ZnSO_4.7H_2O$ | 90 | 11.8% | 291° | 3.9 | 146% | 78% | 62% |
| 0.5% $Zn(NO_3)_2.6H_2O$ | 90 | 11.4% | 302° | 3.9 | 102% | 71% | 65% |
| 0.5% $ZnSO_4.7H_2O$ | 120 | 11.7% | 287° | 4.0 | 106% | 80% | |
| 1.0% $ZnSO_4.7H_2O$ | 120 | 11.9% | 295° | 4.1 | 86% | 73% | |
| 0.5% $ZnSO_4.7H_2O$[a] | 90 | 13.7% | 301° | 4.0 | 89% | 72% | 68% |
| 0.5% $ZnSO_4.7H_2O$[b] | 90 | 10.3% | 281° | 2.9 | 269% | 85% | |
| 0.5% $ZnSO_4.7H_2O$[c] | 90 | 14.5% | | | 63% | | |
| (DMDHEU)[d] | | 7.5% | 297° | 3.5 | 30% | 58% | 52% |
| (Untreated)[e] | | | 191° | 1.4 | (100) | (100) | (100) |

[a]N—methylolacrylamide concentration was increased to 15.8%.
[b]No 4,4'-azobis(4-cyanovaleric acid) was used in this run.
[c]The first stage cure was as 80° C. instead of 110° C.
[d]Fabric conventionally treated with DMDHEU for comparison.
[e]Fabric not given treatment.

EXAMPLE 1

Two-Stage Curing of N-Methylolacrylamide with Cotton Fabric in the Presence of a Water-Soluble Azo Free Radical Initiator and a Phosphate Buffer An aqueous fabric treating bath was prepared containing 13.2% by weight of N-methylolacrylamide, 0.20% 4,4'-azobis(4-cyanovaleric acid), 1.8% monosodium phosphate monohydrate, 0.50% phosphoric acid, a specified concentration of a Lewis acid as indicated in Table I, 1.0% N,N'-methylenebis(acrylamide), 0.07% of a nonionic wetting agent, and 2.0% cationic emulsified polyethylene softener in water.

An all-cotton desized, scoured and bleached 80×80 printcloth weighing 3.4 oz/yd$^2$ was thoroughly wet in this treating bath, was passed between wringer rolls, again wet in the treating bath and again passed through the wringer, the pressure of the wringer rolls being sufficient to permit a 101%-110% wet pickup of mixture on the fabric, based on the original fabric weight.

The fabric was then given a first stage cure in a forced draft oven at 110° C. for five minutes to remove all water and cause polymerization of the N-methylolacrylamide in the fibers of the cotton fabric. The fabric was given a second stage cure in a forced draft oven at 160° C. for the period of time specified in Table I, to graft the poly (N-methylolacrylamide) to the cotton cellulose and thus produce cellulose crosslinking. The fabric was then washed in hot running water for 15 minutes to remove any soluble by products and unreacted starting materials, and was oven-dried at 110° C. for 5 minutes.

The properties of the treated fabric appear in Table I, as a function of Lewis acid catalyst and second stage cure time. For comparison purposes the results of a conventional durable press treatment with dimethyloldihydroxyethyleneurea (DMDHEU) is also shown in The data of the first six tabulated runs show extraordinarily high Stoll flex abrasion resistance in the durable press fabrics that were obtained, the values being 2.9-7.0 times as great as for a conventional treatment with DMDHEU, and in several cases the abrasion resistance equaled or exceeded even that for untreated fabric. Yet the wrinkle resistance and durable press appearance ratings were higher than for the DMDHEU treatment, and were fully comparable to the performance levels sought in commercial finishing. Moreover, the fabrics treated with N-methylolacrylamide by two-stage curing possessed higher tearing and breaking strength than DMDHEU-treated fabric. The two-stage cure afforded a higher degree of control over the rate and timing of the polymerization process. If the first stage cure were replaced by a simple predry at 80° C., which is a temperature too low to induce polymerization of N-methylolacrylamide prior to the cellulose crosslinking step at 160° C., the flex abrasion resistance fell to less than half the value observed for the two-stage curing process.

The data also show that the water-soluble free radical initiator 4,4'-azobis(4-cyanovaleric acid) was essential to obtain adequate curing, a high level of wrinkle resistance, and satisfactory durable press performance.

Measurement of the stiffness of the fabric of Table I showed that all of the fabrics given a two-stage cure with zinc sulfate catalyst had bending moments of $4.1\times10^{-4}$-$4.9\times10^{-4}$ in.lbs., the zinc nitrate catalyzed two-stage treatment resulted in a value of $5.1\times10^{-4}$ in.-lbs., and the DMDHEU treatment led to a value of $5.5\times10^{-4}$ in.-lbs., as compared to $5.3\times10^{-4}$ in.-lbs. for untreated fabric. Thus the experimental treatments of the present invention produced fabrics that were softer, more supple and less stiff than either the untreated fabric or fabric treated with DMDHEU. This was observed to be the case in spite of the considerable fabric weight gains occurring in the N-methylolacrylamide treatments. In whiteness the fabrics treated with N-methylolacrylamide were equal to the fabric treated with DMDHEU.

EXAMPLE 2

The Roll of the Phosphate Buffer in Two-Stage Curing

An aqueous fabric treating bath was prepared containing 13.2% by weight of N-methylolacrylamide, 0.2% 4,4'-azobis (4-cyanovaleric acid), specified amounts of monosodium phosphate monohydrate and phosphoric acid as indicated in Table II, 0.5% zinc sulfate heptahydrate, 1.0% N,N'-methylenebis (acrylamide), 0.07% of a nonionic wetting agent and 2.0% cationic emulsified polyethylene softener in water.

An all-cotton desized, scoured and bleached 80×80 printcloth weighing 3.4 oz/yd$^2$, the same base fabric as used in Example 1, was thoroughly wet in this treating bath, was passed between wringer rolls, again wet in the treating bath and again passed through the wringer, the pressure of the wringer rolls being sufficient to permit a 101%–110% wet pickup of mixture on the fabric, based on the original weight of the fabric.

The fabric was then given a first stage cure in a forced draft oven at 110° C. for five minutes to remove all water and cause polymerization of the N-methylolacrylamide in the fibers of the cotton fabric. The fabric was given a second stage cure in a forced draft oven at 160° C. for 90 seconds to graft the poly(N-methylolacrylamide) to the cotton cellulose and thus produce cellulose crosslinking.

Properties of the treated cotton printcloth are shown in Table II as a function of the concentrations of phosphoric acid and monosodium phosphate in the fabric treating bath.

TABLE I

| % $H_3PO_4$ | % $NaH_2PO_4.H_2O$ | Fabric Weight Gain | Conditioned Wrinkle Recovery Angle (Warp & Fill) | Durable Press Rating | Retention of Stoll Flex Abrasion Resistance | Warp Tear Strength Retained | Warp Break Strength Retained |
|---|---|---|---|---|---|---|---|
| None | None | 6.6% | 265° | 2.5 | 342% | 91% | |
| 0.25 | None | 11.7% | 292° | 4.1 | 86% | 68% | 63% |
| 0.25 | 0.22 | 11.1% | 292° | 4.0 | 161% | 77% | |
| 0.25 | 0.45 | 11.5% | 296° | 4.0 | 116% | 78% | 60% |
| 0.50 | 0.90 | 12.1% | 303° | 4.0 | 40% | 67% | |
| 0.50 | 1.30 | 11.4% | 300° | 3.9 | 109% | 77% | |
| 0.50[a] | 1.80[a] | 11.8% | 291° | 3.9 | 146% | 78% | 62% |
| 0.75 | 1.80 | 12.9% | 296° | 3.8 | 50% | 74% | |

[a]The second run of Table I, included for comparison.

The data show that with zinc sulfate as the Lewis acid catalyst, phosphoric acid was also necessary as a cellulose crosslinking catalyst to obtain the desired wrinkle resistance and durable press performance, and the addition of monosodium phosphate increased the flex abrasion resistance and tearing strength retained during the crosslinking treatment. The optimum ratio of monosodium phosphate to phosphoric acid increased as the amount of phosphoric acid present was increased.

The degree of whiteness of the treated fabrics was equal to that of the DMDHEU-treated fabric of Table I.

EXAMPLE 3

Use of Phosphonium Salts as Accelerators in Two-Stage Curing

An aqueous fabric treating bath was prepared containing 13.2% by weight of N-methylolacrylamide, 1.8% monosodium phosphate monohydrate, 0.50% phosphoric acid, a specified amount of zinc sulfate heptahydrate as indicated in Table III, 1.0% N,N'-methylenebis(acrylamide), 0.93% tetrakis(hydroxymethyl)phosphonium sulfate having the formula $[(HOCH_2)_4P]_2SO_4$ and hereafter referred to as THPS, 0.07 part of a nonionic wetting agent, and 2.0% cationic emulsified polyethylene softener in water.

An all-cotton desized, scoured and bleached 80×80 printcloth weighing 3.4 oz/yd$^2$, the same base fabric as used in Example 1, was thoroughly wet in the treating bath, was passed between wringer rolls, again wet in the treating bath and again passed through the wringer, the pressure of the wringer rolls being sufficient to permit a wet pickup of treating formulation on the fabric of 101%–110% based on the original fabric weight.

The fabric was then given a first stage cure in a forced draft oven at 110° C. for five minutes to remove all water and cause polymerization of the N-methylolacrylamide in the fibers of the cotton fabric. The fabric was given a second stage cure in a forced draft oven at 160° C. for 90 seconds to graft the poly(N-methylolacrylamide) to the cotton cellulose and thus produce cellulose crosslinking. The fabric was then washed in hot running water for 15 minutes to remove any soluble byproducts and unreacted starting materials, and was oven-dried at 100° C. for 5 minutes.

The properties of the treated fabric appear in Table III, along with the results of a run made without zinc sulfate catalyst. Also included in Table III are runs with 4,4'-azobis(4-cyanovaleric acid) also present, with and without zinc sulfate.

TABLE III

| % THPS | % Azo Initiator[a] | % $ZnSO_4.7H_2O$ | Fabric Weight Gain | Conditioned Wrinkle Recovery Angle (Warp & Fill) | Durable Press Rating | Retention of Stoll Flex Abrasion Resistance | Accelerotor Weight Loss | Warp Tear Strength Retained |
|---|---|---|---|---|---|---|---|---|
| 0.93 | None | None | 11.7% | 284° | 4.1 | 82 | 6.7(1.9)% | 76% |
| 0.93 | None | 0.5 | 11.3% | 302° | 4.0 | 101 | | 71% |
| None[c] | None | 0.5 | 10.3% | 281° | 2.9 | 269 | | 85% |
| 0.93 | 0.60 | None | 15.1% | 302° | 4.1 | 58 | | 73% |
| 0.93 | 0.60 | 0.5 | 15.7% | 304° | 4.3 | 37 | | 68% |
| None[c] | 0.20 | 0.5 | 11.8% | 291° | 3.9 | 146 | 13.9(2.0)% | 78% |
| (5% | | | 7.5% | 297° | 3.5 | 30 | 15.3(1.6)% | 58% |

TABLE III-continued

| % THPS | % Azo Initiator[a] | % $ZnSO_4.7H_2O$ | Fabric Weight Gain | Conditioned Wrinkle Recovery Angle (Warp & Fill) | Durable Press Rating | Retention of Stoll Flex Abrasion Resistance | Accelerotor Weight Loss | Warp Tear Strength Retained |
|---|---|---|---|---|---|---|---|---|
| DMDHEU)[c] Untreated) | | | | 191° | 1.4 | (100) | | (100) |

[a]When present to the extent of 0.6%, the 4,4'-azobis(4-cyanovaleric acid) was solubilized by addition of pyridine.
[b]Values in parentheses are for untreated fabric.
[c]These runs appear in Table I also, except for Accelerotor data.

The data quite unexpectedly show that when the phosphonium salt, THPS, was present, no free radical initiator such as 4,4'-azobis(4-cyanovaleric acid) was needed to obtain adequate curing of N-methylolacrylamide, as measured by durable press appearance rating. With THPS and zinc sulfate both present, extremely high wrinkle recovery angles were also observed, and the whiteness of treated fabric was equal to that obtained in the DMDHEU-treated fabric. In absence of zinc sulfate catalyst, the use of THPS to accelerate the N-methylolacrylamide polymerization resulted in a treated fabric having a whiteness greater than that of DMDHEU-treated fabric.

In the absence of the azo initiator, THPS-acelerated runs imparted high flex abrasion resistance. Moreover, the relative fabric weight loss in Accelerator abrasion tests was only half as great as in the best runs with the azo initiator present, as judged from the ratio of weight loss in test fabric to weight loss in the untreated control fabric. The experimental fabrics were also greatly superior to conventional DMDHEU-treated fabric in durable press rating, flex and Accelerator abrasion resistance and strength retention.

EXAMPLE 4

Two-Stage Curing in the Absence of Phosphate Buffers but Using Various Bases to Solubilize the Azo Initiator; Effect of Various First Stage Cure Temperatures An aqueous fabric treating bath was prepared containing 13.2% by weight of N-methylolacrylamide, 0.60% 4,4'-azobis(4-cyanovaleric acid), a specified base as indicated in Table IV, 0.5% zinc nitrate hexahydrate, 1.0% N,N'-methylenebis(acrylamide), 0.07% of a nonionic wetting agent, and 2.0% cationic emulsified polyethylene softener in water.

An all-cotton desized, scoured and bleached 80×80 printcloth weighing 3.4 oz/yd$^2$, the same base fabric as used in Example 1, was thoroughly wet in this treating bath, was passed between wringer rolls, again wet in the treating bath and again passed through the wringer, the pressure of the wringer rolls being sufficient to permit a 101%–110% wet pickup of mixture on the fabric, based on the original weight of the fabric.

The fabric was then given a first step cure for 5 minutes in a forced draft oven at a specified temperature indicated in Table IV, and subsequently given a second stage cure at 160° C. for 90 seconds. The fabric was washed in hot running water for 15 minutes, and was oven-dried at the same temperature as used in the first stage cure.

The properties of the treated fabric appear in Table IV. Also included for comparison are runs without the azo initiator, or with a low concentration of azo initiator in absence of added base.

TABLE IV

| Added Base[a] | 1st Stage Temp. | Fabric Weight Gain | Conditioned Wrinkle Recovery Angle (Warp & Fill) | Durable Press Rating | Retention of Stoll Flex Abrasion Resistance | Warp Tear Strength Retained | Warp Break Strength Retained |
|---|---|---|---|---|---|---|---|
| 0.2% py | 110° C. | 12.6% | 299° | 4.2 | 100% | 73% | |
| 0.2% py | 95° | 13.3% | 300° | | 46% | 68% | |
| 0.2% py | 80° | 14.5% | 298° | | 51% | 66% | |
| 0.2% py[b] | 110° | 9.6% | 269° | 3.1 | 217% | 85% | |
| 0.055% $NH_3$ | 110° | 11.5% | 294° | 4.2 | 91% | 71% | 62% |
| 0.055% $NH_3$ | 95° | 11.3% | 296° | 3.8 | 102% | 73% | |
| 0.055% $NH_3$ | 80° | 13.7% | 300° | 3.7 | 24% | 67% | |
| 0.087% NaOH | 110° | 9.3% | 242° | 2.9 | 324% | 95% | |
| 0.087% NaOH[c] | 110° | 12.7% | 289° | 4.1 | 52% | 67% | |
| 0.087% NaOH[d] | 110° | 12.1% | 286° | 4.0 | 116% | 74% | 65% |
| None (No azo) | 110° | 8.3% | 278° | 3.6 | 222% | 84% | |
| None (0.2% azo) | 110° | 10.6% | 293° | 3.8 | 122% | 74% | |
| (5% DMDHEU)[e] | | 7.5% | 297° | 3.5 | 30% | 58% | 52% |

[a]py = pyridine, azo = 4,4'-azobis(4-cyanovaleric acid).
[b]In place of zinc nitrate, 0.5% $ZnSO_4.7H_2O$ was used in this run.
[c]Concentration of $Zn(NO_3)_2.6H_2O$ was 1.0% in this run.
[d]In addition to 0.5% $Zn(NO_3)_2.6H_2O$, 0.6% $ZnCl_2$ was also present in this run.
[e]Same run using DMDHEU as shown in Table I.

The data show that with zinc nitrate as the Lewis acid catalyst, and with base added to increase the solubility of the azo initiator, there was no need for any phosphoric acid-monosodium phosphate buffer to achieve high durable press appearance ratings along with high wrinkle resistance, high flex abrasion resistance and improved retention of tearing and breaking strength. The purpose of the base added in testing bath was to solubilize the 4,4-azobis(4-cyanovaleric acid) by forming a water soluble salt of this initiator, thus permitting higher concentrations of initiator to be used. When this was done, zinc sulfate did not prove sufficiently active as a Lewis acid catalyst, but zinc nitrate was highly effective. When sodium hydroxide was the based added, extra Lewis acid, preferably zinc chloride, had to be added along with the zinc nitrate normally used. In all cases the whiteness of the N-methylolacrylamide-treated fabric was equal to that obtained in DMDHEU-treated fabric.

The data also show that a sharp drop in flex abrasion resistance resulted if the temperature of the first stage cure were as low as 80° C., at which the azo initiator is inactive and remains unused. In this instance uncontrolled polymerization occurred as the temperature was raised to 160° C. in the second stage cure, since the azo initiator was still present in this case. The threshold temperature suitable for the first stage cure varied somewhat with the particular base used.

Runs 1 and 5 of Table IV were repeated omitting the second stage cure at 160° C. Fabric weight gains were 9.6% and 8.3% respectively, and the fabrics so treated were entirely lacking in wrinkle resistance or smooth drying properties. This is evidence that polymerization of most of the N-methylolacrylamide occurred in the first stage cure, but grafting and crosslinking to cellulose occurred in the second stage cure. The water-insolubility of much of the polymer formed in the first stage is evidently the result of crosslinking produced in the homopolymer by N,N'-methylenebis(acrylamide) included in these illustrative formulations.

If the N-methylolacrylamide treatment of the first run of Table IV were carried out using a cure temperature as low as 80° C. in the first stage cure, and the second stage cure was omitted, the fabric weight gain fell to −0.1% after correcting for polyethylene deposition and the methylenebis(acrylamide) which was polymerized, showing that no N-methylolacrylamide polymerized under these conditions.

We claim:

1. A process for imparting to cellulosic textiles a high level of wrinkle resistance, smooth drying properties and abrasion resistance, without high strength loss or marked discoloration in the textile, comprising:

(a) immersing the cellulosic textile in an aqueous treating solution containing sufficient concentrations of: N-methylolacrylamide, 4,4'-azobis(4-cyanovaleric acid) solubilized by a base, a buffered catalyst and a crosslinking agent for the polymerization of N-methylolacrylamide to impregnate the textile;

(b) removing the excess treating solution from the textile;

(c) heating the textile at a temperature of from about 95° C. to 130° C. for from about ½ to 10 minutes to dry and polymerize the N-methylolacrylamide in the cellulose of the textile;

(d) heating the textile at a temperature of about 145° C. to 180° C. for from about ½ to 6 minutes to graft the polymerized N-methylolacrylamide to the cellulose of the textile;

(e) washing the textile with water to remove excess reagents.

2. The process of claim 1 wherein the cellulosic textile is immersed in a solution containing from 5% to 20% by weight of N-methylolacrylamide, from 0.10% to 1.0% 4,4'-azobis(4-cyanovaleric acid) solubilized at concentrations exceeding 0.20% by addition of a base selected from the group consisting of ammonia, triethylamine, pyridine, sodium hydroxide and sodium bicarbonate.

3. The process of claim 2 wherein the amount of said base being used in one mole per mole of 4,4'-azobis(4-cyanovaleric acid).

4. The process of claim 3 wherein the buffered catalyst is from about 0.15% to 2.0% monosodium phosphate and from 0.25% to 1.5% phosphoric acid, the ratio by weight of phosphoric acid to monosodium phosphate being in the range of from about 0.25:1 to 1.5:1; from about 0.10% to 1.0% of a Lewis acid catalyst selected from the group consisting of zinc sulfate and zinc nitrate and zinc chloride.

5. The process of claim 4 wherein the crosslinking agent for the polymerization of N-methylolacrylamide is from about 0.50% to 1.50% of N,N-methylenebis(acrylamide) in water.

6. The process of claim 5 wherein the cellulosic textile is immersed in an aqueous treating solution containing from 5% to 20% by weight of N-methylolacrylamide, from 0.30% to 1.0% of 4,4'-azobis(4-cyanovaleric acid) solubilized by addition of a base selected from the group consisting of ammonia, triethylamine, pyridine, sodium hydroxide, and sodium bicarbonate, the amount of said base being one mole per mole of 4,4'-azobis(4-cyanovaleric acid); from 0.10% to 1.0% of zinc nitrate, and from 0.5% to 1.5% of N,N'-methylenebis(acrylamide) in water.

7. The process of claim 5 wherein the cellulosic textile is immersed in an aqueous treating solution containing from 5% to 20% by weight of N-methylolacrylamide, from 0.15% to 2.0% of monosodium phosphate, from 0.25% to 1.5% phosphoric acid, the ratio by weight of phosphoric acid to monosodium phosphate being in the range of 0.25:1 to 1.5:1; from 0.50% to 1.5% of N,N-methylenebis(acrylamide) in water, and from 0.30 to 1.5% of tetrakis(hydroxymethyl) phosphonium sulfate in water.

8. A process for imparting to cellulosic textiles a high level of wrinkle-resistance, smooth-drying properties and abrasion-resistance, without high strength loss or marked discoloration in the textile, comprising:

(a) immersion of the cellulosic textile in an aqueous treating solution containing from 5% to 20% by weight of N-methylolacrylamide, from 0.30% to 1.0% of 4,4'-azobis(4-cyanovaleric acid) solubilized by addition of a base selected from the class consisting of ammonia, triethylamine, pyridine, sodium hydroxide and sodium bicarbonate, the amount of said base being one mole per mole of 4,4'-azobis(4-cyanovaleric acid); from 0.10% to 1.0% of zinc nitrate, and from 0.50% to 1.5% of N,N'-methylenebis(acrylamide) in water;

(b) removal of excess treating solution from the textile;

(c) heating the textile at a temperature of from 95° C. to 130° C. for from 0.5 minutes to 10 minutes to dry the textile and polymerize the N-methylolacrylamide in the fibers of the textile;

(d) heating the textile at a temperature of from 145° C. to 180° C. for from 0.5 minutes to 6 minutes to graft the polymerized N-methylolacrylamide to the cellulose of the textile;

(e) washing the textile with water to remove excess reagents.

9. A process for imparting to cellulosic textiles a high level of wrinkle-resistance, smooth-drying properties and abrasion-resistance, without high strength loss or marked discoloration in the textile, comprising:

(a) immersion of the cellulosic textile in an aqueous treating solution containing from 5% to 20% by weight of N-methylolacrylamide, from 0.30% to 1.0% of 4,4'-azobis(4-cyanovaleric acid) solubilized by addition of a base selected from the class consisting of sodium hydroxide and sodium bicarbonate, the amount of said base being one mole per mole of 4,4'-azobis(4-cyanovaleric acid); from 0.10% to 1.0% of zinc nitrate, from 0.10% to 1.0% of zinc chloride and from 0.50 to 1.5% of N,N-methylenebis(acrylamide) in water;

(b) removal of excess treating solution from the textile;

(c) heating the textile at a temperature of from 95° C. to 130° C. for from 0.5 minutes to 10 minutes to dry the textile and polymerize the N-methylolacrylamide in the fibers of the textile;

(d) heating the textile at a temperature of from 145° C. to 180° C. for from 0.5 minutes to 6 minutes to graft the polymerized N-methylolacrylamide to the cellulose of the textile;

(e) washing the textile with water to remove excess reagents.

10. The process of claim 8 wherein the base is selected from the class consisting of ammonia, triethylamine and pyridine.

11. An improved process for imparting wrinkle-resistance to cotton textiles while retaining high abrasion resistance, strength and freedom from discoloration, wherein a chemical accelerator is used to speed N-methylolacrylamide polymerization initiated by heat only which improvement comprises:

(a) immersing the cellulosic textile in an aqueous treating solution containing from 5% to 20% by weight of N-methylolacrylamide, from 0.15% to 2.0% of monosodium phosphate, from 0.25% to 1.5% phosphoric acid, the ratio by weight of phosphoric acid to monosodium phosphate being in the range of 0.25:1 to 1.5:1; from 0.50% to 1.5% of N,N-methylenebis(acrylamide) in water, and from 0.30% to 1.5% of tetrakis(hydroxymethyl)phosphonium sulfate in water;

(b) removal of excess treating solution from the textile;

(c) heating the textile at a temperature of from 95° C. to 130° C. for from 0.5 minutes to 10 minutes to dry the textile and polymerize the N-methylolacrylamide in the fibers of the textile;

(d) heating the textile at a temperature of from 145° C. to 180° C. for from 0.5 minutes to 6 minutes to graft the polymerized N-methylolacrylamide to the cellulose of the textile;

(e) washing the textile with water to remove excess reagents.

* * * * *